US005294193A

United States Patent [19]

Wegman et al.

[11] Patent Number: 5,294,193

[45] Date of Patent: * Mar. 15, 1994

[54] MODULAR DESK WITH ADJUSTABLE MONITOR SUPPORT

[75] Inventors: Thomas Wegman; John N. Lechman, both of Effingham, Ill.

[73] Assignee: Nova Manufacturing & Assembly, Inc., Effingham, Ill.

[ * ] Notice: The portion of the term of this patent subsequent to Jun. 30, 2009 has been disclaimed.

[21] Appl. No.: 778,333

[22] Filed: Oct. 17, 1991

Related U.S. Application Data

[63] Continuation-in-part of Ser. No. 693,392, Apr. 30, 1991, Pat. No. 5,125,727, which is a continuation-in-part of Ser. No. 595,864, Oct. 11, 1990, abandoned.

[51] Int. Cl.[5] ..... A47B 81/00

[52] U.S. Cl. ..... 312/223.3; 312/208.1; 108/107

[58] Field of Search ..... 312/194, 7.2, 208.1, 312/223.3; 108/107

[56] References Cited

U.S. PATENT DOCUMENTS

| | | | |
|---|---|---|---|
| 4,590,866 | 5/1986 | Schairbaum | 312/7.2 X |
| 4,755,009 | 7/1988 | Price et al. | 312/194 |
| 5,071,204 | 12/1991 | Price et al. | 312/194 |
| 5,087,010 | 2/1992 | Walters | 248/455 |
| 5,125,727 | 6/1992 | Lechman et al. | 312/194 |

FOREIGN PATENT DOCUMENTS

| | | | |
|---|---|---|---|
| 0560631 | 4/1975 | Switzerland | 108/107 |

*Primary Examiner*—Peter R. Brown
*Assistant Examiner*—Gerald A. Anderson
*Attorney, Agent, or Firm*—Olson & Hierl, Ltd.

[57] ABSTRACT

A desk structure is provided that is adapted for use in a modular work environment. The desk structure has a transparent portion in its top member and incorporates a pair of side walls, a bottom shelf, and a back brace. The desk structure is cooperatively associated with an underdesk adjustable monitor support assembly. The support assembly incorporates a shelf member and a pair of side supports and such are all preferably comprised of formed wire. Each side support is associated with desk components including adjacent portions of one side wall, the top member, the bottom shelf, and the back brace. The shelf member is adjustably associated with the side supports.

8 Claims, 3 Drawing Sheets

MODULAR DESK WITH ADJUSTABLE MONITOR SUPPORT

RELATED APPLICATION

This application is a continuation-in-part of our U.S. patent application Ser. No. 693,392 filed Apr. 30, 1991 now U.S. Pat. No. 5,125,727 which is a continuation-in-part of U.S. patent application Ser. No. 595,864 filed Oct. 11, 1990 now abandon.

FIELD OF THE INVENTION

This invention relates to a desk structure adapted for use in a modular environment and having a transparent top portion through which a monitor can be viewed and also having an underdesk monitor support assembly.

BACKGROUND OF THE INVENTION

We have previously provided a new and very useful type of underdesk monitor support assembly for desk structures, computer work stations and the like that have a transparent top portion through which a monitor can be viewed; see the above referenced parent patent application Ser. No. 693,392. Although this type of monitor support assembly is well suited for use in free standing desks, computer work stations, and the like, we have observed that such a monitor support assembly would also be suitable for use in work modules and the like if a desk structure suitable for use in a modular environment were available which was cooperatively integratable with such a monitor support assembly.

Although modular office structures are already in extensive use, the field of use appears to be still growing. In such a structure, wall and even floor surfaces of cubicle defining members are associatable where practical with functional furniture components. A common objective in such structures is to provide a maximized usable working area (volumetrically and also surface-area wise). A desk structure that has a transparent top portion and is associatable with an underdesk adjustable monitor support would be well suited for such modular applications.

The present invention provides such a desk structure.

SUMMARY OF THE INVENTION

The present invention provides a desk structure adapted for use in adjacent relationship to a support structure, such as a conventional modular wall panel or the like.

The desk structure has a transparent portion in its flat top member through which a monitor situated under such portion can be viewed, for example, by a worker seated adjacent to the front edge of the top member.

The desk structure is also in cooperative association with an adjustable monitor support assembly located under the top member. The monitor support assembly is of the type having a shelf member is adjustably supported at each lateral end thereof by a different one of a pair of side supports. Each side support is cooperatively associated with structural components of held by the desk structure.

Optionally but preferably, the desk structure is additionally provided with a keyboard-supporting platform which is slidably horizontally movable from a storage position under the top member to an extended position projecting outwardly from the top member front edge.

To stabilize the desk structure against tilting when the support assembly holds a monitor and when a downward force is being exerted upon the top member adjacent the front edge region thereof by documents, a user or the like, the desk structure is provided with mounting means for securing the desk structure to an adjacent structure, such as a vertical modular wall panel or the like.

The present invention thus achieves a desk structure with a transparent top portion and an associated underdesk monitor support assembly. The desk structure is well adapted for use in a working area or office cubicle adjacent wall regions that are defined by modular wall panels or the like. Preferably, the monitor support assembly is adjustable.

The desk structure and the underdesk monitor support assembly are cooperatively integrated with one another to provide a safe, effective, and efficient unitary combination.

The desk structure is relatively simple and reliable, and is easy to assemble from a kit or the like. Thereafter, an associated adjustable underdesk monitor support assembly is easily and safely adjustable. If desired, the assembled desk structure can be subsequently easily disassembled, relocated for use elsewhere, and reassembled.

The desk structure provides a maximal working area for a worker and is well suited for modular-type application and use environments.

Other and further objects, aims, features, purposes, advantages, modifications, embodiments and the like will be apparent to those skilled in the art from the teachings of the present specification taken with the appended drawings and associated claims.

BRIEF DESCRIPTION OF THE DRAWINGS

In the drawings.

FIG. a perspective view of one embodiment of a modular desk of the present invention.

DETAILED DESCRIPTION

Figure 1:
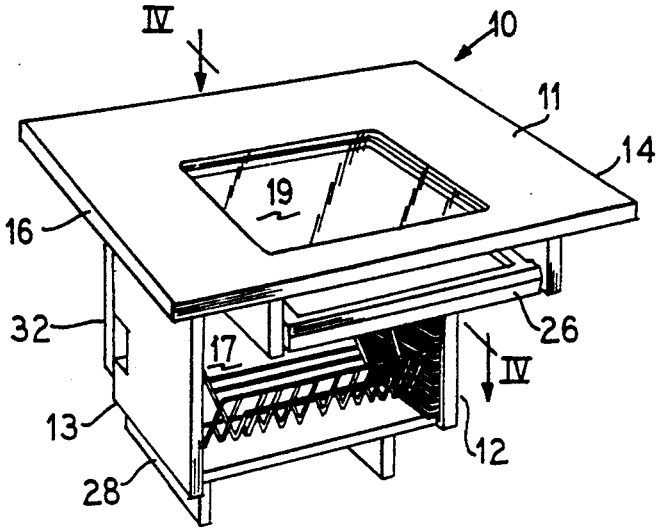
Figure 2:
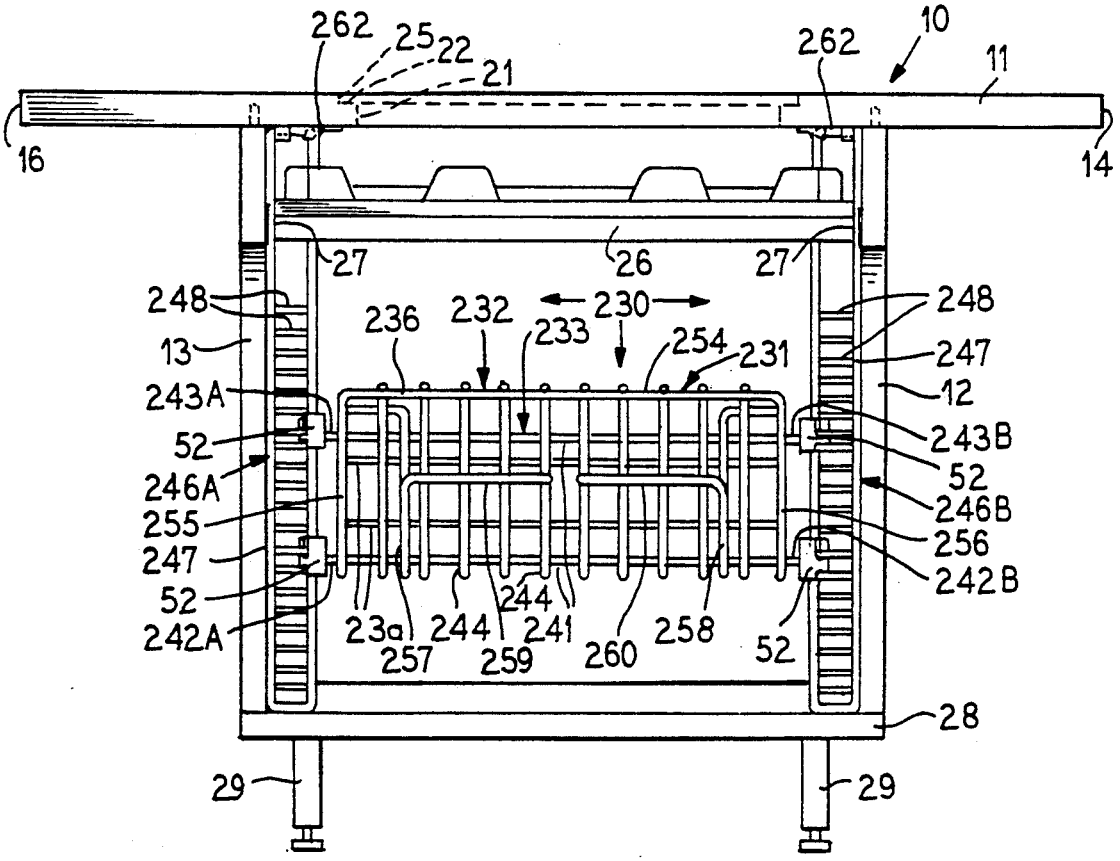
FIG. 2 is a front side elevational view of the embodiment shown in FIG. 1.
Figure 3:
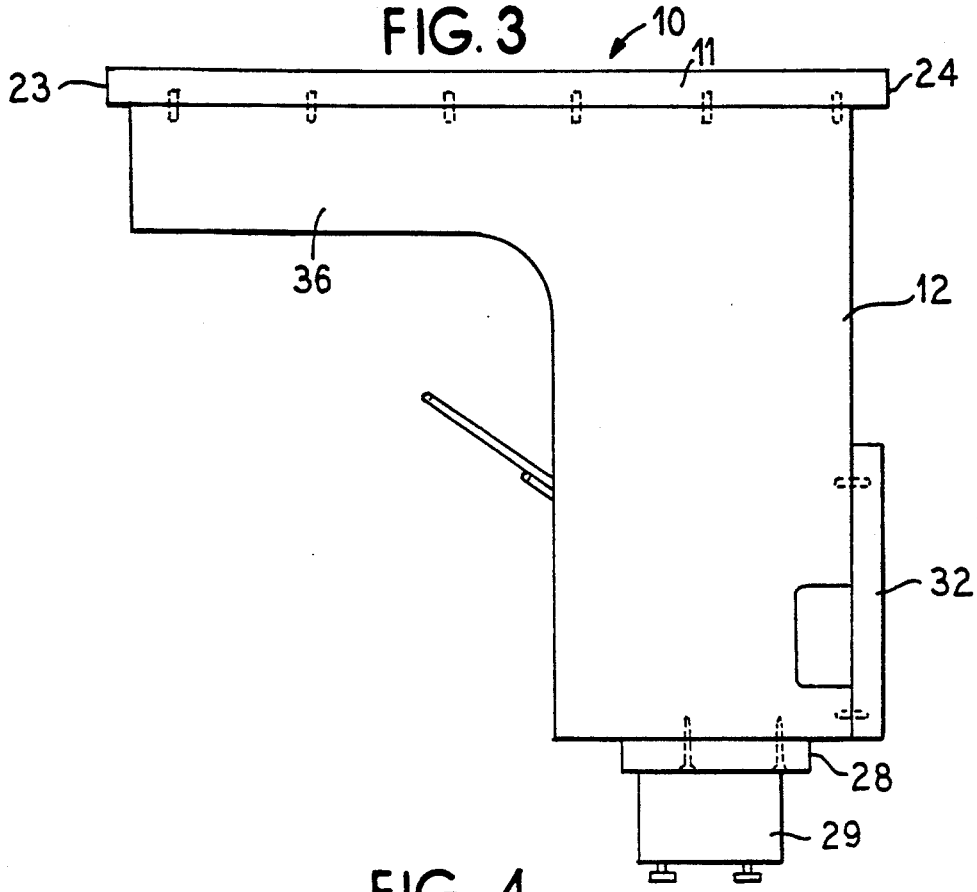
FIG. 3 is a right side (relative to the front side) elevational view of the embodiment shown in FIG. 1 (the left side image of the right side)

Referring to FIGS. 1 through 5, there is seen an embodiment of a desk structure 10 of the present invention. The desk structure 10 has a preferably rectangular or square configured, generally horizontal extending flat top member 11 that is supported by a pair of side walls 12 and 13. Thus, a side wall 12 downwardly extends from top member 11 at a location that is inset laterally from the adjacent side 14 of top member 11 and a side wall 13 downwardly extends from top member 11 at a location that is inset laterally from the opposite side 16 (relative to side 14) of top member 11. The side walls 12 and 13 are preferably in spaced, parallel relationship to each other and define therebetween a kneehole 17.

Top member 11, side walls 12 and 13, and other structure components of desk structure 10 as hereinafter described, are each conveniently formed of a preferably thickened, dimensionally stable material, such as wood or wood based material, filled plastic, formed sheet metal, a combination of materials, or the like. Wood or wood based materials are presently preferred, such as plywood, particle board, fiber board, and the like, and each component piece so comprised of such a material is preferably conventionally laminated on its respective opposed outer faces to a layer comprised of a melamine polymer or the like. Exposed edge portions are preferably also similarly covered by such a laminate layer.

Top member 11 has an aperture 18 formed therein which has beveled sides that are adapted to support and hold edge portions of a fitted transparent member 19 that is formed of clear glass or clear plastic (such as a polyacrylic resin or the like). Preferably, and as shown (see FIGS. 4 and 5, for example), the lower portion of the side walls defining the aperture 18 in top member 11 are provided with an inwardly projecting flange 21 so that edge adjacent portions peripherially about the transparent member 19 can rest upon a horizontal flat upper shoulder 22 thereof with the upper portion 25 of the sides of aperture 18 being perpendicular relative to shoulder 22. Aperture 18 is conveniently centrally formed in top member 11 relative to the lateral sides 14 and 16, and is conveniently nearer to the front edge 23 of top member 11 than to the back edge 24 thereof. Aperture 18 is preferably square or rectangular in perimeter configuration and is preferably substantially larger in surface area than the surface area of the monitor screen to be viewed therethrough. Aperture 18 is located over kneehole 17 between the side walls 12 and 13.

The respective body portion 41 and 42 of each of the side walls 12 and 13 extends vertically the full distance from contacting engagement with the adjacent portions of the underface of the top member 11 to a predetermined bottom support. In the embodiment 10, bottom support for body portions 41 and 42 is provided by a horizontally extending shelf member 28. A lower end portion of each bottom portion 41 and 42 rests upon a different lateral opposite end edge region of shelf member 28 (see FIGS. 2 and 4, for example).

Shelf member 28 on its underface is supported in embodiment 10 by a pair of upstanding flattened legs 29 each of which is in laterally spaced, parallel relationship to the other thereof, and each of which is laterally inset from its adjacent opposite end of shelf member 28.

Each of the side walls 12 and 13 is further provided with an integrally formed respective forward extension 36 and 37 along its upper edge region. Each such forward extension 36 and 37 supports along its respective top edge adjacent forward underface portions of top member 11. Also, each such extension 36 and 37 provides an inside surface region for mounting a rail 34 by screws 31 or the like for an optional but preferred keyboard support platform 21.

Thus, under the top member 11 across the top portion of kneehole 17 there is preferably located a transversely short keyboard holding or supporting platform 26 that is transversely and horizontally slidable from the closed position shown in FIG. 1 to a fully extended position whereat a keyboard which rests upon platform 26 is fully exposed and usable by a worker seated before front edge 23. Sliding capability is conveniently achieved by means of a pair of conventional rails 27 mounted one along each parallel lateral side of platform 26. The rails 27 engage the rails 34 to provide horizontal slidability for platform 26. While various structures for platform 26 can be employed, a presently preferred structure is shown and described in copending U.S. patent application Ser. No. 774,416 filed Oct. 10, 1991 now U.S. Pat. No. 5,205,621.

Between bottom adjacent portions of each side wall 12 and 13 extends a back brace 32. Adjacent to a midportion of back brace 32 in each of the sidewalls 12 and 13 a notched rectangularly configured cutout 33 is provided. The cutout 33 is adapted to accommodate an enclosed conventional cable channel (not shown). If used, the cable channel housing can incorporate a base plate that is optionally mounted against the front face of back brace 32, and then a domed elongated cover structure can be associated with the base plate with the cover extending into the cutouts 33. Such a cable channel housing is useful in interconnecting together by appropriate wiring one or more desks 10 (and their respective monitor(s) and keyboard(s) (not shown) with a computer or central processing unit (CPU) (not shown)).

The bottom edge of each leg 29 is conveniently and preferably provided with a pair of transversely spaced adjustable screw-type levelers 33 which are conventionally threadably received into socket members (not shown) that are inset into the bottom edges of each leg 29.

The top edge of each leg 29 is conveniently secured to adjacent contacting bottom facial portions of the shelf member 28 by Phillips-type screws or the like that extend through shelf member 28 downwardly. The bottom edges of each side wall 12 and 13 that contact the shelf member 28 are conveniently secured the adjacent contacting upper facial portion of shelf member 28 at each end of shelf member 28 by Phillips-type screws or the like that extend through shelf member upwardly.

The back brace 32 is conveniently provided with a connector bolt 46 mounted so as to extend therefrom at respective locations approximately each of its four corners. The shank portion of each such bolt 46 is slidably received within a mating channel (not shown) formed in the back edge portions of each side wall 12 and 13. Conventional cam screws 47 associated with each such channel in the sidewalls 12 and 13 are then turned (by a screw driver) into engagement with respective bolts 46 to bring the back brace 32 into a desired tight engagement with the respective side panels 12 and 13. A plurality of projecting bolts or a combination of projecting bolts and studs 48 are inset into the upper horizontal edge portion of each side panel 12 and 13 at respective locations therealong which are aligned with mating channels provided along contacting surface portions of the underface of top member 11. Also, if desired, similar projections (not shown) from the underside of top member 11 can be provided which are receivable in mating channels (not shown) that are formed in the top edge portions of each side wall 12 and 13. When the top member is positioned upon side walls 12 and 13 and the projections are received in top member 11, conventional cam screws 49 are provided in side walls 12 and 13 which, when turned, engage screw members (not shown) to bring the top member 11 into a desired tight engagement with each side wall 12 and 13. After assembly, a desk 10 can have its top surface 11 leveled at an installation location by adjusting the levelers 33. Thereafter, the desk 10 can be secured by fastening means, such as screws, nut and bolt assemblies, or the like to an adjacent module panel (not drawn) or the like, such fastening means conveniently extending through holes 51 provided in back brace 32. Those skilled in the art will appreciate that various fastening means and arrangements may be employed for assembling a desk structure 10 and securing same to a desired supporting member.

The adjustable monitor support assembly that is associated with the desk structure 10 is preferably characterized by having an open grill or mesh-like structure at least for its monitor supporting shelf surface so as to enhance heat dissipation from a monitor when in use. Referring to FIGS. 1 through 5, there is seen a presently preferred embodiment of an underdesk adjustable monitor support assembly 230 which is incorporated into a desk structure 10 of the present invention; this support assembly is as shown and described in the above referenced parent patent application 693,392.

The adjustable monitor support assembly 230 is conveniently and preferably comprised of formed heavy (i.e., relatively thick steel wire or the like) wire components that are interwelded together at locations of contact therebetween and then individual components are coated with an electrically insulating and mechanical shock (impact) absorbing material, such as is achieved by dipping into a conventional polyvinyl chloride plastisol coating composition and drying, or the like. Such a coating layer is desirable for reasons of avoiding accidental physical impacts thereagainst with a monitor and/or avoiding accidental current flow through a component of a monitor support assembly, as those skilled in the art will appreciate. Assembly 230 incorporates a shelf member 231 having a flattened bottom support member 232 and an integrally formed flattened back member 233 that upstands preferably perpendicularly and extends unitarily from a rear edge region 234 of bottom member 232 (see FIGS. 2 and 4, for example).

Thus, shelf member 231 incorporates a perimeter defining wire 236 which has a mid point located in the middle of the front edge 254 of bottom support member 232. To define each opposed lateral side edge 255 and 256, respectively, of bottom support 232, the wire 236 is bent at about 90 degrees relative to front edge 254 at each opposed end of front edge 254. To define each opposed lateral side edge 237 and 238, respectively, of back member 233, the wire 236 is again bent in two places, each bend being at rear edge region 234 and being at about 90 degrees relative to each lateral side edge 255 and 256, respectively, and also perpendicular relative to front edge 254. At the upper end of each opposed lateral side edge 237 and 238, the wire 236 is again bent, this time in two successive 90 degree turns, each such turn being in relatively closely spaced relationship to the other thereof, so as to produce a pair of short sections 240A and 240B therebetween which in effect together define the back upper end edge 240 of the back member 233. Such short sections 240A and 240B are preferably, as in the present embodiment of shelf 231, in spaced, parallel relationship to the front edge 254. Each such pair of successive 90 degree turns together with the sections 237A and 238A therebetween thus defines a generally U-shaped arrangement for wire 236 which provides strength for back member 233 and produces two lengths of the wire 236 that are in spaced, parallel, coplanar relationship to each other adjacent each lateral side edge 237 and 238, respectively.

At rear edge region 234, as one continues along the wire 236 in each direction from its mid-point, the wire 236 is once again bent at about a 90 degree angle at two locations, thereby to provide a pair of spaced, generally parallel lengths 257 and 258. These lengths 257 and 258 however, extend slightly out of parallel alignment (see FIG. 4) with the respective portions of the wire 236 that define each of the lateral side edges 237 and 238, respectively, so that the wire 236 can undergo a final 90 degree turn to produce a pair of terminal wire sections 259 and 260 therein that are in an aligned, opposed, generally coaxial relationship with one another. Sections 259 and 260 each provide a supportive function, as hereinafter explained.

Back member 233 is further provided in shelf member 231 with a pair of parallel, longitudinally (laterally relative to desk 10) extending, vertically (transversely relative to desk 10) spaced back member supporting wires 239 and also with a pair of parallel, and longitudinally (laterally relative to desk 10) extending, vertically (transversely relative to desk 10) spaced, shelf-supporting wires 241.

One of the wires 241 which is adjacent the rear edge region 234 provides at opposite end portions thereof a first pair of opposed shelf support shafts 242A and 242B which extend laterally and longitudinally outwardly from the back member 233. The other one of the wires 241 which is spaced from the rear edge region 234, but which is preferably adjacent to a back edge 240 of back member 233, provides at its opposite end portions a second pair of opposed shelf support shafts 243A and 243B which likewise extend laterally and longitudinally outwardly from the back member 233.

Also, the space between the lateral end edges 255 and 256 of bottom member 232 is provided with a plurality of spaced, parallel, transversely extending, bottom member supporting wires 244 which extend beyond the rear edge region 234, but which are bent upwards at rear edge region 234 at 90°. All wires 244 are welded to at least one of each of wires 241 and 239 at locations of contact therebetween, as well as to the wire 236 along front edge 254, thereby to provide a bottom support platform and to add to the rigidity desired for retaining the desired 90 degree angular relationship between back member 233 and bottom member 232. Such rigidity is desirable because, in the preferred assembled support assembly 230, the bottom member 232 is cantilevered from back support member 233 and is not otherwise held or supported when a monitor rests on bottom support member 232. To provide added rigidity for the platform portion of bottom member 232, each of the wires 244 which contacts one of the terminal sections 259 and 260 is also welded thereto. Thus, shelf member 231 is itself supported and held along its opposite sides only by the respective opposed shelf support shafts 242 (paired) and 243 (paired).

Support assembly 230 further incorporates a pair of generally rectangularly configured side supports 246A and 246B which are left and right mirror images of each other. Each side support 246A and 246B is oriented generally vertically and is disposed at a different opposed lateral end edge of shelf member 231. Like shelf member 231, each of the side supports 246A and 246B is preferably formed of heavy wire. Thus (see FIGS. 4 and 5) each support 246A and 246B is defined along edge portions by a perimeter defining wire 247 which is folded (bent) inwardly to define a flange 252 in each side support 246A and 246B that extends outwardly relative to shelf member 231 along each transversely spaced front and rear edge of each side support 246 for structural support and rigidity purposes.

Figure 4:
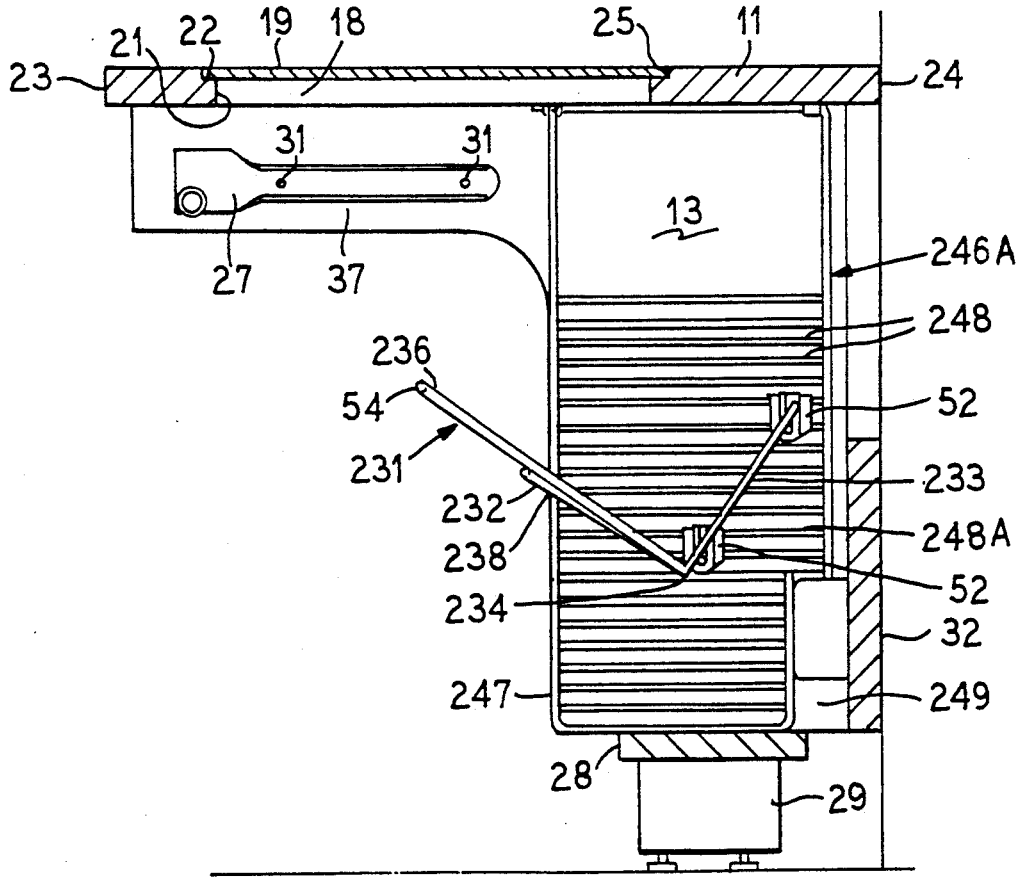
FIG. 4 is a transverse vertical sectional view taken along the line of FIG. 1 with the sliding keyboard platform removed.
Figure 5:
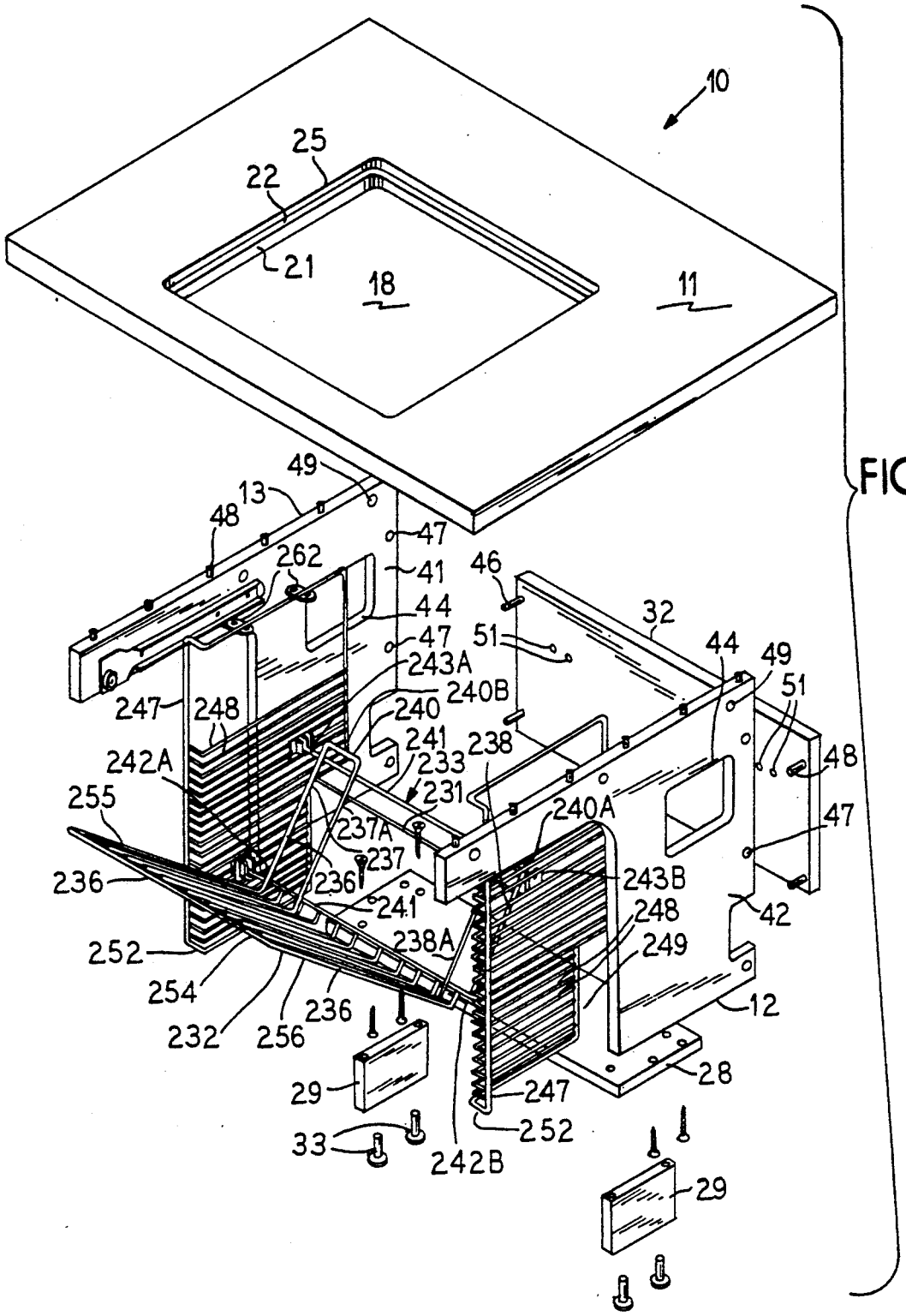
FIG. 5 is an exploded perspective view of the embodiment shown in FIG. 1 with the transparent member and the sliding keyboard platform removed, and with apertures defined in the desk side supports.

In the embodiment 230, and as shown in FIGS. 4 and 5, for example, each side support 246 has a slot 249 removed from the lower inside edge portion thereof for purposes of accommodating an enclosed cable channel housing (not shown) such as hereinabove characterized and which, if used, runs lengthwise across the inside of back brace 32. In addition, a plurality of horizontally extending, vertically generally equally spaced support wire members 248 are provided for each side support 246. Wires 248 are each welded to respective associated wires 247 at each point of contact therebetween. The wires 248 thus provide a ladder-rung-like configuration which is utilized in mounting and positioning a shelf member 232 in the monitor support assembly 230 as shown and as described herein.

The top edge portion of each side support 246A and 246B, that is, a top portion of wire 247, is clamped by U-clamps 262, C-configured brackets, or the like, to an adjacent underside portion of desk top member 11 which are in adjacent relationship to the transparent member 19 that is inset into the top member 11 of the desk structure 10. Also, the back edge wire portions of each side support 246 are similarly conveniently clamped against inside surface portions of back brace 32. In the now preferred embodiment shown, one wire member 248A projects rearwardly and is bent downwardly at its terminus to define an "L" configuration which is convenient for use in clamp engagement. In addition, the bottom edge wire portions of each side support 246 rest against adjacent surface portions of shelf 28.

The transverse width of the vertically extending body portion 41 and 42 of each side wall 12 and 13 is such that the vertically extending edge portion of the flange 252 of each side support 246A and 246B (as defined by perimeter wire 247) is in adjacent contacting relationship with a surface portion of each one respective associated body portion 41 and 42.

Thus, each side support 246A and 246B is cooperatively associated with each of an adjacent side wall 12 and 13, and with adjacent portions of shelf member 28, back brace 32 and top member 11 in a fixed supportive and braced interrelationship. Hence, the monitor support structure 230 is provided with side supports which are effectively integrated into the desk structure 10.

The shelf member 231 is vertically adjustably positionable and also adjustably tiltably positionable relative to the side supports 246. A monitor (not shown) is thus adjustably supportable and orientable by the shelf member 231. While the shelf member 231 can be joined to each of the side supports 246 by any convenient means, as those skilled in the art will readily appreciate; however, in a preferred mode of practicing this invention, each of the support shafts 242 (paired) and 243 (paired) is adjustably positioned and held in a desired place relative to a side support 246 by a locking block assembly 52, such as described in our aforereferenced parent patent application Ser. No. 693,392 which is fully incorporated thereinto by reference.

An optional but preferred feature is shown in FIG. 5 where a hand grasping and access hole 44 is provided in each body portion 41 and 42 of the respective side walls 12 and 13.

Various other and further embodiments, applications, structures and the like will be apparent to those skilled in the art from the teachings herein provided and no undue limitations are to be drawn therefrom.

What is claimed is:

1. A desk comprising in combination (a) structural components comprising:

(1) a top member having a transparent portion;

(2) a pair of side walls supporting said top member and defining therebetween a space for a monitor support assembly, each side wall having a bottom edge and a rear edge;

(3) a bottom shelf member extending laterally and rearwardly between said bottom edges of said side walls;

(4) a back brace member extending laterally across said rear edges of said side walls; and (5) mounting means for securing said components together;

(b) a monitor support assembly located generally in said space under said top member and adjacent said side walls comprising:

(1) a shelf member which includes a bottom support portion and a back support portion and having lateral opposite ends;

(2) a pair of side supports, each one positioned adjacent a different one of said lateral opposite ends;

(3) fastening means for securing each one of said side supports to at least one of said structural components; and (4) adjustable supporting means for engaging each one of said side supports to a different adjacent one of said lateral opposite ends of said shelf member; and (c) the interrelationship between said structural components and said monitor support assembly additionally being such that each of said side supports is in contacting association with adjacent portions of a different one of said side walls, and also with said top member, said bottom shelf member, and said back brace member.

2. The desk of claim 1 wherein said bottom shelf member is supported in elevated spaced relationship to a surface by a pair of laterally spaced leg members.

3. The desk of claim 1 which additionally includes securing means for securing at least one of said structural components to an adjacent room wall member.

4. The desk of claim 3 wherein said securing means is threaded, said one structural component is said back brace means, and said room wall member is in module panel.

5. The desk of claim 1 wherein, in said monitor support assembly, said shelf member and said side supports are each comprised of wire, and (a) said back support portion is integral with said bottom support portion and extends at a fixed angle from the rear edge thereof, and said shelf member includes first and second pairs of opposed shelf support means wherein said first and said second pairs each laterally outwardly extend from a different one of said lateral opposite ends;

(b) each one of said pair of said supports has a plurality of vertically spaced load bearing members; and (c) said adjustable supporting means so engages each member of said first and second pairs of opposed shelf support means with selected ones of said load bearing members; so that said shelf member is adjustably supported in a desired location from said pair side supports under said top member.

6. The desk of claim 1 wherein a keyboard support platform is additionally included, said platform being horizontally moveable from a retracted position that is under and adjacent to said top member to an extended position that is adjacent to and forward of a front edge of said top member, and including rail means for accomplishing said horizontal movements slidably.

7. The desk of claim 5 wherein said first and second pairs of opposed support means are located in said back support.

8. A desk comprising in combination (a) structural components comprising:

(1) a top member having a transparent portion, (2) a pair of side walls supporting said top member and defining therebetween a space for a monitor support assembly, each side wall having a bottom edge and a rear edge, (3) a bottom shelf member extending laterally and rearwardly between said bottom edges of said side walls, (4) a back brace means for supporting said side walls extending laterally across said rear edges of said walls, and (5) mounting means for securing said components together;

(b) a monitor support assembly located generally in said space under said top member and adjacent said side walls comprising:

(1) a shelf member which includes a bottom support portion and a back support portion and having lateral opposite ends, (2) a pair of side supports, each one positioned adjacent a different one of said lateral opposite ends, (3) fastening means for securing each one of said side supports a different one of said lateral opposite ends, (4) adjustable supporting means for engaging each one of said side supports to a different adjacent one of said lateral opposite ends of said shelf member;

(c) the interrelationship between said structural components and said monitor support assembly additionally being such that each of said side supports is in contacting association with adjacent portions of a different one of said side walls, and with said top member, said bottom shelf member, and said back brace means;

(d) said monitor support assembly, said shelf member and said side supports each being comprised of wire, and (1) said back support portion being integral with said bottom support portion and extending at a fixed angle from the rear edge thereof, and said shelf member including first and second pairs of opposed shelf support means wherein said first and second pairs each laterally outwardly extend from a different one of said lateral opposite ends, (2) each one of said pair of said side supports having a plurality of vertically spaced load bearing members, and (3) said adjustable supporting means so engages each member of said first and second pairs of opposed shelf support means with selected ones of said load bearing members, so that said shelf members is adjustably supported in a desired location from said pair of side supports under said top member; and (e) said adjustable supporting means each being comprised of a plurality of locking block assemblies, each said locking block assembly comprising:

(1) a rung block member having a pair of generally vertically spaced, parallel, longitudinally open support grooves defined therein, each support groove extending through said rung block member and being slidably engagable with a different adjacent one of each of two of said load bearing members, and a longitudinally open shelf groove defined therein, said shelf groove extending perpendicuarly relative to said support groove and terminating in said rung block member, and including an overlying channel extending through said rung block member and intersecting one of said grooves, and (2) a locking block member having block means for slidable extension through said channel, and guidance means for limiting sliding movement of said locking block member relative to said rung block member, so that, when said locking block member is so engaged with said rung block member, said support grooves and said shelf groove are each closed and said locking block member is secured to wire portions of said shelf member that are seated in said so closed support grooves and shelf groove.

* * * * *

UNITED STATES PATENT AND TRADEMARK OFFICE

CERTIFICATE OF CORRECTION

PATENT NO. : 5,294,193

DATED : March 15, 1994

INVENTOR(S) : Thomas Wegman and John N. Lechman

It is certified that error appears in the above-indentified patent and that said Letters Patent is hereby corrected as shown below:

Col. 1, line 10, "abandon." should be --abandoned.--.

Col. 1, line 24, "693,392." should be --693,392 now U.S. Pat. No. 5,125,727.--.

Col. 2, line 37, "FIG. a" should be --FIG. 1 is a--.

Col. 2, line 43, "side image" should be --side being a mirror image--.

Col. 2, line 45, "line of" should be --line IV-IV of--.

Col. 5, line 15, "693,392." should be --693,392 now U.S. Pat. No. 5,125,727.--.

Col. 8, Claim 2, line 3, "to a surface" should be --to a floor surface--.

Signed and Sealed this

Twenty-third Day of August, 1994

*Attest:*

Bruce Lehman

BRUCE LEHMAN

*Attesting Officer*

*Commissioner of Patents and Trademarks*